US009113678B2

(12) United States Patent
Leung

(10) Patent No.: US 9,113,678 B2
(45) Date of Patent: Aug. 25, 2015

(54) BELT BUCKLE

(71) Applicant: Ching Fung Apparel Accessories Co. Ltd., Kowloon (HK)

(72) Inventor: Kwok Yun Gary Leung, Kowloon (HK)

(73) Assignee: CHING FUNG APPAREL ACCESSORIES CO. LTD., Hong Kong (CN)

( * ) Notice: Subject to any disclaimer, the term of this patent is extended or adjusted under 35 U.S.C. 154(b) by 229 days.

(21) Appl. No.: 13/689,692

(22) Filed: Nov. 29, 2012

(65) Prior Publication Data

US 2014/0053380 A1 Feb. 27, 2014

(30) Foreign Application Priority Data

Aug. 22, 2012 (HK) ..... 12108208

(51) Int. Cl.
*A44B 11/25* (2006.01)
*A44B 11/20* (2006.01)

(52) U.S. Cl.
CPC ..... *A44B 11/20* (2013.01); *A44B 11/258* (2013.01); *A44B 11/2588* (2013.01); *A44D 2201/06* (2013.01); *Y10T 24/45623* (2015.01)

(58) Field of Classification Search
CPC ..... A44D 2200/12; A44B 11/258; A44B 11/2588
USPC ..... 24/DIG. 38, DIG. 52, DIG. 51, 453, 326, 24/462, 351, 307, 108, 598.1, 595.1, 24/594.11, 573.11, 578.15
See application file for complete search history.

(56) References Cited

U.S. PATENT DOCUMENTS

| | | | | |
|---|---|---|---|---|
| 3,052,005 | A | 9/1962 | Wilson et al. | |
| 3,520,033 | A | 7/1970 | Usuda | |
| 6,067,694 | A * | 5/2000 | Candotti | 24/662 |
| 2008/0005875 | A1 * | 1/2008 | Friedman et al. | 24/578.15 |

FOREIGN PATENT DOCUMENTS

| | | | |
|---|---|---|---|
| CN | 88211430 | U | 12/1988 |
| CN | 2531653 | Y | 1/2003 |
| CN | 2759229 | Y | 2/2006 |
| CN | 101262790 | A | 9/2008 |
| GB | 796663 | A | 6/1958 |

* cited by examiner

*Primary Examiner* — Jack W Lavinder
(74) *Attorney, Agent, or Firm* — Eagle IP Limited; Jacqueline C. Lui

(57) ABSTRACT

A belt buckle includes a male plate with a cylindrical pin extending transversely from a back side of said male plate. A female plate includes a cylindrical cavity which is partially enclosed by a first inwardly-extending flange and a second inwardly-extending flange. The female plate is adapted for coupling to a male plate when the buckle is in use. An elastic ring is fittingly disposed inside the partially enclosed cavity. A hollow of the elastic ring is adapted to fittingly receive the pin during use of the buckle. The hollow of the elastic ring has a polygonal-shaped wall, whereby the elastic ring is in contact with the pin at a plurality of contact points during use of the buckle to prevent the pin from getting loose when the buckle is in use.

11 Claims, 6 Drawing Sheets

BELT BUCKLE

FIELD OF INVENTION

This invention relates to a belt buckle, and in particular the invention relates to a belt buckle with an improved locking mechanism.

BACKGROUND OF INVENTION

Belt buckle is a buckle, or a clasp for fastening two ends of straps or a belt, in which a device attached to one of the ends is fitted or coupled to the other. Belt buckles and other fixtures are used on a variety of belts.

A belt buckle is to hold a belt tight around an object and makes sure that buckle plates will not separate and let the belt loose using a reliable locking mechanism for securing the buckle plates.

SUMMARY OF INVENTION

In the light of the foregoing background, it is an object of the present invention to provide a belt buckle with an improved locking mechanism that will not let plates loose easily and hold the belt tightly. The improved locking mechanism allows a user to engage and disengage a belt buckle plate easily. At the same time, the belt buckle has an attractive appearance.

Accordingly, the present invention, in one aspect, is a belt buckle including a male plate with a cylindrical pin extending transversely from a back side of the male plate. A female plate is adapted for coupling to a male plate when the buckle is in use. The female plate includes a cylindrical cavity, a first open end of a front side of the cylindrical cavity being partially enclosed by a first inwardly-extending flange; and a second open end of a back side of the cylindrical cavity being partially enclosed by a second inwardly-extending flange to create a partially enclosed cavity. An elastic ring is fittingly disposed inside the partially enclosed cavity. A hollow of the elastic ring is adapted to fittingly receive the pin during use of the buckle. The hollow of the elastic ring has a polygonal-shaped wall, whereby the elastic ring is in contact with the pin at a plurality of contact points during use of the buckle.

In one embodiment of the present invention, the female plate further comprises a frame and a brace plate. The brace plate comprises a first inwardly-extending flange, a protrusion extending transversely and outwardly from the second open end of the back side of the cylindrical cavity and a second inwardly extending flange. The second inwardly extending is disposed at the extending end of the protrusion.

In another aspect, the present invention is a belt buckle that includes a male plate comprising a front side and a back side, and a cylindrical pin extending transversely from the back side of the male plate. The cylindrical pin has a first diameter. A female plate comprises a front and a back side. The female plate is adapted for coupling to the male plate when the buckle is in use. The female plate comprises a cylindrical cavity that has a second diameter bigger than the first diameter and a first inwardly-extending flange at a first flange hole at the front side of the cylindrical cavity. The first flange hole has a third diameter less than the second diameter but large enough for the cylindrical pin to pass through. An elastic ring is disposed inside the cylindrical cavity. The elastic ring has a regular polygonal shape that further comprises a plurality of outer vertices and inner straight edges. The inner straight edges define an inner circle that touches all the inner straight edges and the outer vertices define an outer circle that touches all the outer vertices. The inner circle has a diameter smaller than the first diameter and the outer circle has a diameter larger than the third diameter but smaller than the second diameter. When the cylindrical pin of the male plate is inserted into the cavity of the female plate, the cylindrical pin stretches all the inner straight edges of the elastic ring, creating frictional force between the cylindrical pin and inner straight edges so that the male plate and the female plate are securely and resiliently coupled together.

In further aspects of the present invention, the elastic ring is preferably hexagonal shape. The elastic ring is made from an elastic material selected from the group consisting of plastics, rubbers, polystyrene, polypropylene and elastomers while the male and female plates are made of either metals, alloys, or wood.

There are many advantages to the present invention, an improved locking mechanism is provided by the interaction between the cylindrical pin and the elastic ring. The frictional force between the metal pin and elastic ring ensures a secure attachment between a male plate and female plate. In addition, the elastic ring is securely housed inside a cavity and will not get loose easily. Thirdly, the mechanism provides easy attachment and detachment mechanism of the belt plates.

Another advantage of the present invention is that the belt buckle has an attractive appearance both before and after insertion of the plates. Before the insertion, both male and female plates have attractive low profile alloy finish. Upon insertion, the top surfaces of both male and female plates flush on the same plane to create a smooth appearance.

BRIEF DESCRIPTION OF DRAWINGS

A general description of a belt buckle of using the same that implements the various features of the invention will now be described with reference to the drawings. The drawings and the associated descriptions are provided to illustrate embodiments of the invention and not to limit the scope of the invention.

DETAILED DESCRIPTION OF THE PREFERRED EMBODIMENTS

As used herein and in the claims, "comprising" means including the following elements but not excluding others. Front surface means the side of a surface that is exposed for external viewing whereas back surface means the opposite side of the front surface that is hidden from external, public view upon tightening a belt.

Figure 1A:
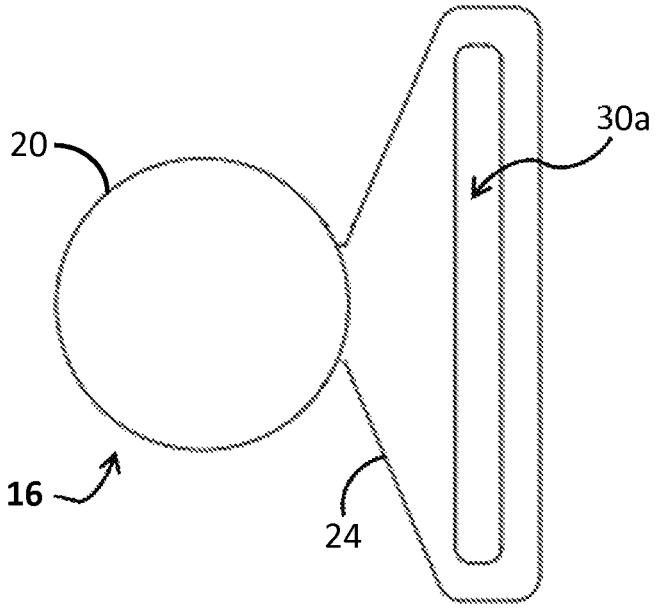
FIG. 1*a* is a schematic of a front view of the male plate of the belt buckle according to a specific implementation example of the invention.
Figure 1B:
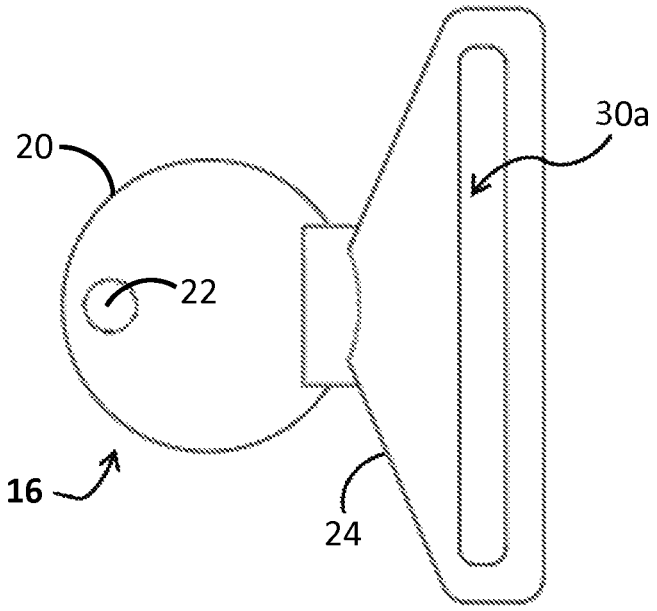
FIG. 1*b* is a schematic of a back view of the male plate of the belt buckle according to a specific implementation example of the invention.
Figure 1C:
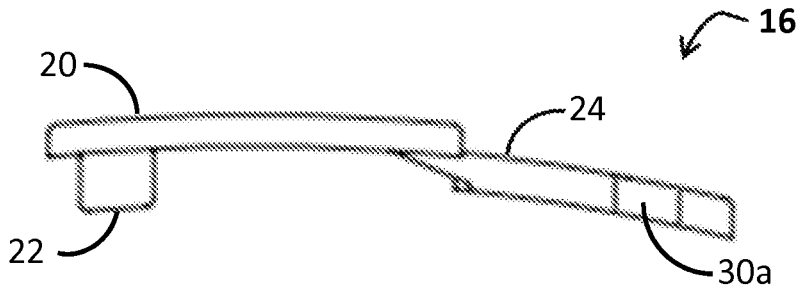
FIG. 1*c* is a cross sectional view along the medial longitudinal axis of the male plate of the belt buckle according to a specific implementation example of the invention.

In an exemplary implementation as shown in FIGS. 1*a*, 1*b* and 1*c*, the male plate 16 comprises a front side and a back side, and a cylindrical pin 22 extending transversely from the back side of the male plate 16. The male plate 16 comprises an insert tongue 20 and a male arm 24. The insert tongue 20 has a first end and an opposing second end. The first end of insert tongue 20 includes a cylindrical pin 22 extending transversely from the back side of the first end thereof, and is diametrically opposite to a male arm 24 at the second end of the insert tongue 20. The male arm 24 connects the insert tongue 20 to a transverse slot 30*a* for attachment to a material such as a belt.

Referring to FIG. 1*c*, the male plate 16 has a male arm 24 connecting an insert tongue 20 and a slot 30*a* for securing a belt at the opposing second end. The insert tongue 20 is raised on a parallel plane above a horizontal level subscribed by the slot 30*a* with the male arm 24 at an angle pointing up from the horizontal axis. This spatial arrangement is calibrated to ensure a proper attachment of the male plate 16 onto the recess depth 50 of the frame 26 of the female plate 18 as shown in FIG. 2*c*.

Figure 2A:
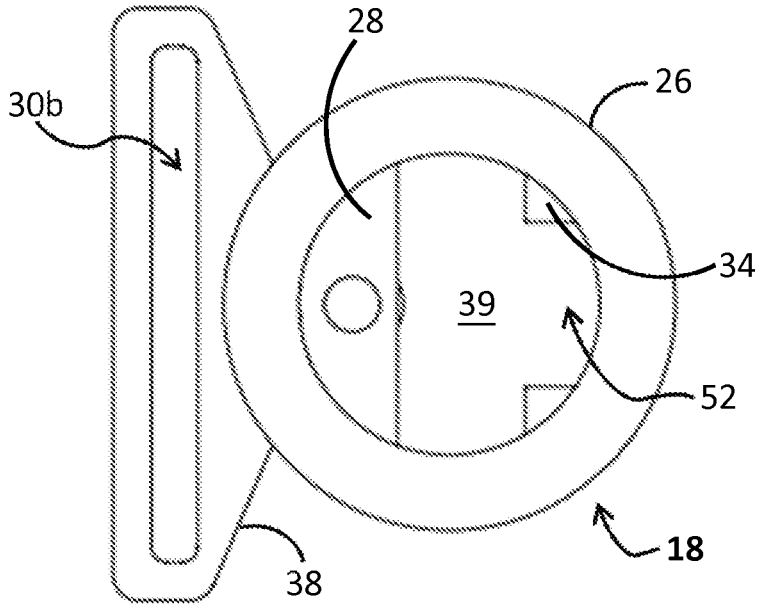
FIG. 2*a* is a schematic of a front view of the female plate of the belt buckle according to a specific implementation example of the invention.
Figure 2B:
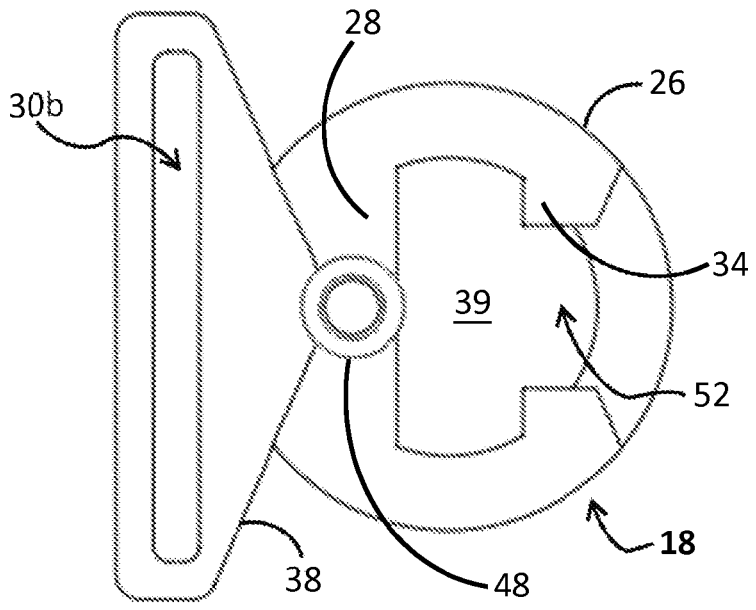
FIG. 2*b* is a schematic of a back view of the female plate of the belt buckle according to a specific implementation example of the invention.
Figure 2C:
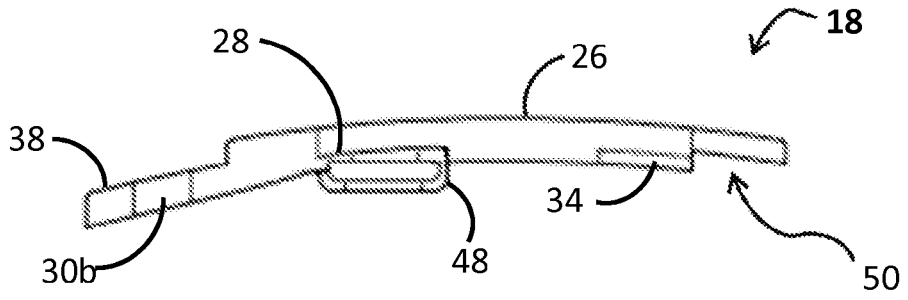
FIG. 2*c* is a cross sectional view along the medial longitudinal axis of the female plate of the belt buckle according to a specific implementation example of the invention.

In an exemplary implementation as shown in FIGS. 2*a*, 2*b* and 2*c*, the female plate 18 comprises a front and a back side. The female plate 18 is adapted for coupling with the male plate 16 when the buckle is in use. It comprises a frame 26 that defines an opening 39 therewithin. The frame 26 further comprises a brace plate 28. In this implementation, a cylindrical protrusion 48 is disposed at the brace plate 28, extending transversely and outwardly from the back surface of the brace plate 28. The brace plate 28, in the shape of a partial circular plate is in a recessed position disposed along the interior wall of the frame 26. The belt buckle has at least one supporting plate 34 disposed along an interior wall of the frame 26 and spaced apart from the brace plate 28. The supporting plates 34 of the female plate 18 are disposed in a recessed position disposed along the interior wall of the frame 26 having a same recess depth 50 with the brace plate 28. A recess gap 52 is formed along the area of the frame 26 defined by the supporting plates 34 on the opposite end of the brace plate 28. The female plate 18 has a female arm 38 connecting the frame 26 and a slot 30*b* for securing the belt at an opposite end of the frame 26. The frame 26 is directed in an inclined position towards a horizontal level subscribed by the slot 30*b* with the female arm 38 at an angle pointing down from the horizontal axis. This spatial arrangement is calibrated to ensure a proper attachment of the male plate 16 onto the recess depth 50 of the frame 26 of the female plate 18.

Figure 3A:
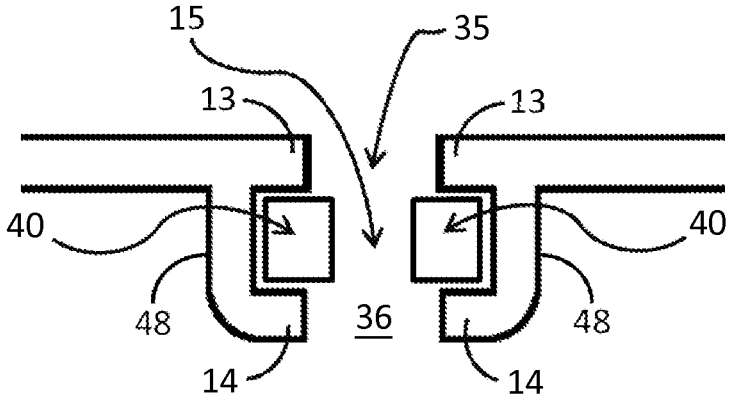
FIG. 3*a* is a longitudinal cross sectional view of the protrusion of the frame of female plate of the belt buckle with an elastic ring included inside the protrusion according to the invention.
Figure 3B:
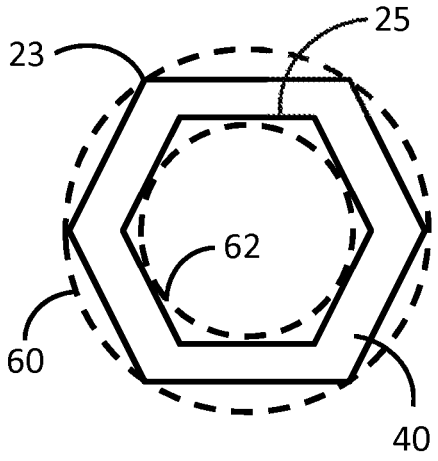
FIG. 3*b* is a horizontal cross sectional view of the elastic ring according to a specific implementation example of the invention.
Figure 3C:
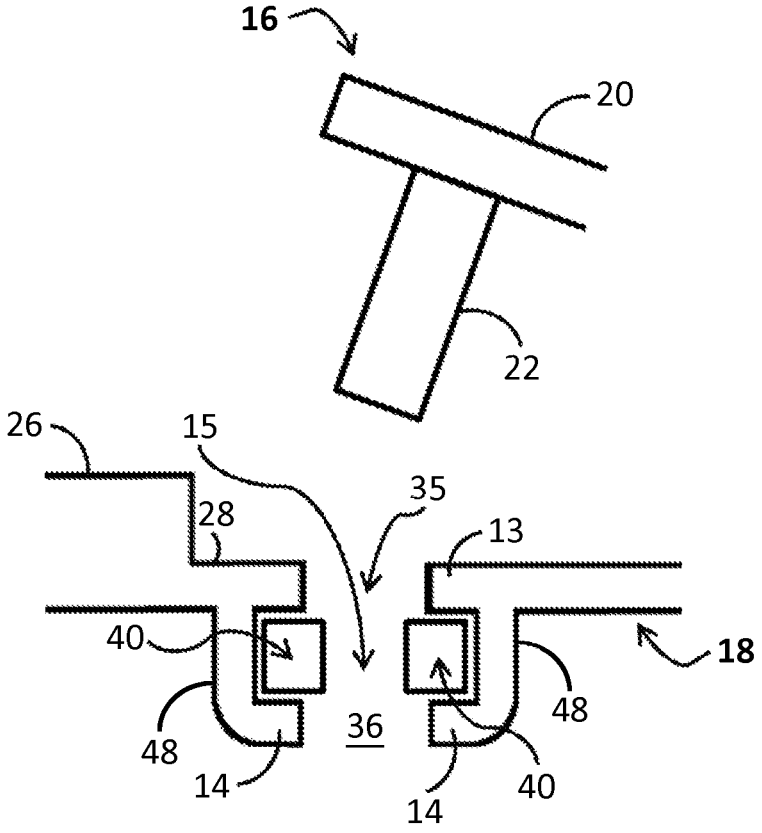
FIG. 3*c* is a schematic diagram of an insertion mechanism of the pin into the protrusion contained in the female plate according to a specific implementation example of the invention.

Referring now to FIGS. 3*a*, 3*b* and 3*c*, the protrusion 48 comprises the cylindrical cavity 15. The first open end of the front side of the cylindrical cavity 15 is partially enclosed by the first inwardly-extending flange 13. The second open end of a back side of the cylindrical cavity 15 is partially enclosed by a second inwardly-extending flange 14 to create a partially enclosed cylindrical cavity 15. An elastic ring 40 is fittingly disposed inside the partially enclosed cylindrical cavity 15. A hollow of the elastic ring 40 is adapted to fittingly receive the pin 22 during use of the buckle. The elastic ring 40 is further sandwiched in the cylindrical cavity 15 between the first inwardly extending flange 13 and the second inwardly extending flange 14. A first flange hole 35 is defined by the first inwardly extending flange 13 whereas a second flange hole 36 is defined by the second inwardly extending flange 14.

Referring to FIG. 3*b*, the elastic ring 40 takes on the shape of a regular hexagonal form which comprises six equal length edges with finite width connected together. Although hexagon is used in this exemplary implementation, it should be noted that any regular polygonal shape can also be used. For any regular polygon, there exists a circle that touches all the edges of this polygon. An inner circle 62 which touches all the inner straight edges 25 is shown in FIG. 3*b*. An outer circle 60 which touches all the outer vertices 23 of the elastic ring 40 is also shown. In order for the elastic ring 40 to be fitted inside the cylindrical cavity 15, the diameter of the cylindrical cavity 15 has to be larger than the diameter of the outer circle 60 of the elastic ring 40. In order for the elastic ring 40 not to escape from the first flange hole 35 or the second flange hole 36, the diameter of the outer circle 60 has to be larger than those of these two flange holes. Likewise, for the cylindrical pin 22 to be inserted into the cylindrical cavity 15, the diameter of the first flange hole 35 needs to be slightly bigger than the diameter of the cylindrical pin 22. Lastly, the diameter of the inner circle 62 must be less than the diameter of the cylindrical pin 22, so that when the cylindrical pin 22 is inserted into the cylindrical cavity 15, it contacts and stretches all the inner straight edges 25 outwardly. This creates frictional force between the cylindrical pin 22 and inner straight edges 25 at the contact points. Using a regular polygonal elastic ring 40 allows the elastic ring 40 to deform more easily and naturally. Furthermore, the elastic ring 40 is securely housed in the protrusion 48 and does not come loose easily during the insertion and desertion of the male plate 16.

In one embodiment, the male plate 16 and the female plate 18 are made from an inelastic material selected from the group consisting of metals, alloys, and wood. In another embodiment, the elastic ring 40 is made from an elastic material selected from the group consisting of plastics, rubbers, polystyrene, polypropylene and elastomers. The advantages of the elastic ring 40, such as plastics, are apparent. Plastics are resilient materials and do not rust like metals. Plastics also last a long time. Therefore, the elastic ring 40 provides a reliable and durable part of the locking mechanism of the belt buckle.

Referring to FIGS. 1*a*, 1*b* and 1*c* and 2*a*, 2*b* and 2*c* for an exemplary embodiment of operation, the male plate 16 is inserted obliquely into and passing the opening 39 of the female plate 18 from the bottom side of the female plate 18 until the second end of the insert tongue 20 is raised above the supporting plates 34. The male plate 16 is then slide along the frame 26 away from the slot 30*b* of the female plate 18 towards the gap 52 that is situated between two supporting plates 34. When the male plate 16 is situated within the gap 52, the male plate 16 is then pivoted around the frame 26 towards the first flange hole 35 of the brace plate 28 of the female plate 18. The cylindrical pin 22 of the male plate 16 is then aligned and inserted into the first flange hole 35 of the female plate 18. At the insertion stage, the insert tongue 20 of the male plate 16 rests completely within the recess depth 50 of the frame 26 of the female plate 18 supported by the brace plate 28 and two supporting plates 34.

To unlock or desert the cylindrical pin 22 from the protrusion 48, the reverse process of the above insertion process is followed. The male plate 16 is pivoted upwards from the female plate 18 to release the cylindrical pin 22 from the first flange hole 35 of the brace plate 28 of the female plate 18. After the desertion of the cylindrical pin 22, the insert tongue 20 hinges upwards around the supporting plate 34. The insert tongue of the male plate 16 is slid along the frame 26 towards the opening 39. The insert tongue 20 can then pulled downwardly out from the back side of the female plate 18. This completes the unlocking or disengagement of the male plate 16 and the female plate.

When the insert tongue 20 of the male plate 16 of the belt buckle is housed completely within the recess depth 50 of the frame 26 of the female plate 18, the cylindrical pin 22 located on the back side of the insert tongue 20 is completely inserted into the protrusion 48 contained herewithin the brace plate 28 of the female plate 18. The insert tongue 20 of the male plate 16 may have a complementary shape with an optional recess area defined by the frame 26 of the female plate 18. Therefore, the insert tongue 20 with the male arm 24 rests completely with support of the brace plate 28 and supporting plates 34 that are extended from the frame 26 of the female plate 18. The front surface of the insert tongue 20 is flush with front surface of the frame 26 of female plate 18 at the inserted position with the complementary orientation of the male arm 24 of the male plate 16 and the female arm 38 of the female plate 18.

The exemplary implementation of the present invention is thus fully described. Although the description referred to particular embodiments, it will be clear to one skilled in the art that the present invention may be practiced without many of these specific details. Hence this invention should not be construed as limited to the embodiments set forth herein.

For example, the elastic ring 40 does not need to be in hexagonal shape. Any regular polygon shapes can also be used.

Figure 4A:
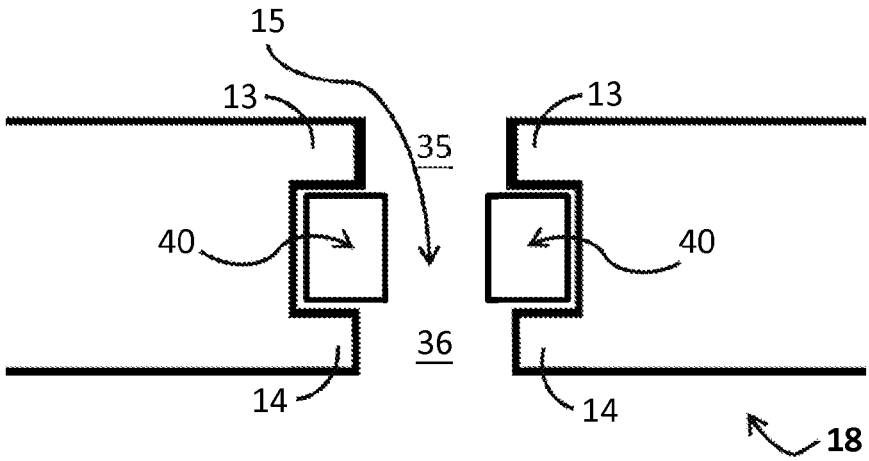
FIG. 4*a* is a cross sectional view of the female plate in a further embodiment whereby a cavity is disposed in the female plate without the protrusion.
Figure 4B:
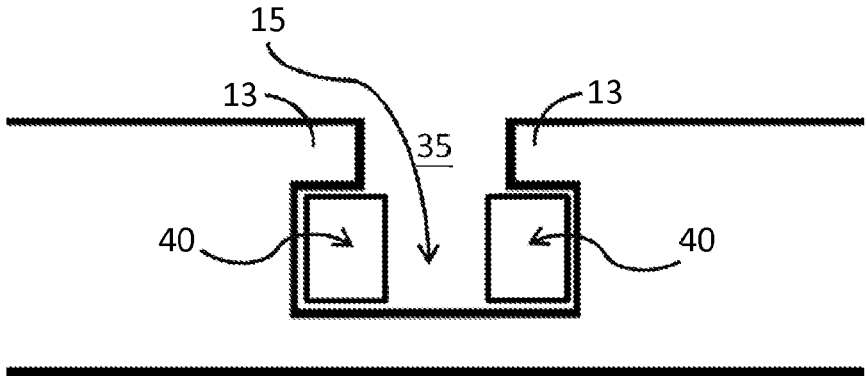
FIG. 4*b* is a cross sectional view of female plate in a further embodiment whereby the cavity comprises only one flange hole

While the cylindrical cavity 15 in the exemplary implementation is housed in the protrusion 48 of the female plate 18, this is but one implementation to illustrate the inventive ideas. Other design configurations can also be adopted to create a cavity 15 with first inwardly extending flange 13 and second inwardly extending flange 14 so that the elastic ring 40 can be fitted inside. For example, a cavity can be created directly in the female plate 18 as shown in FIG. 4*a*. In a further embodiment, the cavity comprises only one flange hole 35 as shown in FIG. 4*b*. These are some design variations. Based on the teaching of this disclosure, those skilled in the art may devise other different design configurations of the cavity 15 that houses the elastic ring 40 but it will still fall into the scope of this invention.

The exemplary implementation of the transversely insertable buckle as shown in FIGS. 1*a*, 1*b*, 1*c* and 2*a*, 2*b*, 2*c* is but one specific implementation of the inventive ideas disclosed in this specification. It is clear that other types of buckle, such as two simple plates that are coupled together by a cylindrical pin 22 extending from the insert tongue 20 of the male plate 16 inserted into a cavity 15 of the female plate 18 is also an embodiment of the present invention, as long as the regular polygonal elastic ring 40 is provided in the cavity 15 to provide friction to hold the cylindrical pin 22.

Returning to the specific implementation example described above, the shape of the frame 26 with its recess depth 50 of the female plate 18 are complementary to the shape of the insert tongue 20 which is round in FIGS. 1*a*, 1*b*, 1*c*, 2*a*, 2*b* and 2*c* above. As long as the shape and the recess depth 50 of the insert tongue 20 of the male plate 16 and the frame 26 of the female plate 18 is complementary, the insert tongue 20 can be situated on top of recess depth 50 defined by the frame 26 of the female plate 18 to make a flush appearance when the buckle is in use. It is clear that other shapes and sizes may be used according to the user's preference, such as oval, square, and rectangular in shape.

In another variation of the specific details, the female plate 18 does not need to have a recess depth 50 as long as the cylindrical pin 22 of the insert tongue 20 of the male plate 16 can be inserted into an elastic ring 40 disposed along the interior wall of a protrusion 48 contained in the female plate 18. In yet another variation of the specific details, a frame 26 of female plate 18 may have an open end at the opposite end of the belt slot 30*b* so that a male plate 16 may be laid directly on front of the frame 26 of the female plate 18 with cylindrical pin 22 aligned and inserted into an elastic ring 40 disposed along the interior wall of a protrusion 48 contained in the female plate 18 without passing through an opening 39 defined by a frame 26, a brace plate 28 and supporting plates 34.

What is claimed is:

1. A belt buckle comprising:

a) a male plate comprising a pin extending transversely from a back side of said male plate; and b) a female plate adapted for coupling to said male plate when said buckle is in use comprising:

i) a cavity;

ii) a first open end of a front side of said cavity being partially enclosed by a first inwardly-extending flange; and iii) a second open end of a back side of said cavity being partially enclosed by a second inwardly-extending flange to create a partially enclosed cavity;

wherein an elastic ring is fittingly disposed inside said partially enclosed cavity, a hollow of said elastic ring being adapted to fittingly receive said pin during use of said buckle, said hollow of said elastic ring having a polygonal-shaped wall, whereby said elastic ring is in contact with said pin at a plurality of contact points during use of said buckle, and wherein said male plate further comprising an insert tongue having a first end and an opposing second end, said first end of said insert tongue having said pin.

2. The belt buckle according to claim 1, wherein said elastic ring is made from an elastic material selected from the group consisting of plastics, rubbers, polystyrene, polypropylene and elastomers.

3. The belt buckle according to claim 1, wherein said elastic ring is preferably hexagonal-shaped.

4. The belt buckle according to claim 1, wherein said male plate and said female plate is made from an inelastic material selected from the group consisting of metals, alloys, and wood.

5. The belt buckle according to claim 1, wherein said female plate further comprising a frame, a brace plate comprising said first inwardly-extending flange and a protrusion extending transversely and outwardly from said second open end of said back side of said cavity; said second inwardly-extending flange being disposed at an extending end of said protrusion.

6. The belt buckle according to claim 1, wherein said first inwarding-extending flange and said second inwardly-extending flange have a diameter smaller than a diameter of an outer wall of said elastic ring and an inside wall of a protrusion has a diameter greater than or equal to said diameter of said outer wall of said elastic ring so that said elastic ring is fittingly disposed along said inside wall of said protrusion and is sandwiched between said first inwardly-extending flange and said second inwardly-extending flange.

7. The belt buckle according to claim 1, wherein an insert tongue of said male plate housed completely within a recess depth of said frame of said female plate, a front side of said insert tongue flush with said front side of female plate during use of said buckle.

8. A belt buckle comprising:

a) a male plate comprising a front side and a back side; and a cylindrical pin extending transversely from said back side of said male plate; said cylindrical pin having a first diameter;

b) a female plate comprising a front and a back side; and adapted for coupling to said male plate when said buckle is in use; said female plate comprising a cylindrical cavity having a second diameter bigger than said first diameter, and a first inwardly-extending flange at a first open end flange hole at said front side of said cylindrical cavity; said first open end flange hole having a third diameter less than said second diameter but large enough for said cylindrical pin to pass through; and c) an elastic ring disposed inside said cylindrical cavity; said elastic ring having a regular polygonal shape further comprising a plurality of outer vertices and inner straight edges; said inner straight edges defining an inner circle that touches all said inner straight edges and said outer vertices defining an outer circle that touches all said outer vertices; said inner circle having a diameter smaller than said first diameter and said outer circle having a diameter larger than said third diameter but smaller than said second diameter so that when said cylindrical pin of said male plate is inserted into said cavity of said female plate, said cylindrical pin stretches all said inner straight edges of said elastic ring, creating frictional force between said cylindrical pin and inner straight edges so that said male plate and said female plate are securely and resiliently coupled together, wherein said female plate further comprises a second inwardly-extending flange at a second open end flange hole at said back side of said cylindrical cavity, and wherein said male plate further comprising an insert tongue having a first end and an opposing second end, said cylindrical pin affixed to said first end of said insert tongue.

9. The belt buckle according to claim 8 wherein said regular polygonal shape is a hexagonal shape.

10. The belt buckle according to claim 8 wherein, said female plate further comprising a frame wherein said cavity is affixed at a first side of said frame, said frame further comprising an opening and a plurality of supporting plates at the opposing side of said first side; said opening adapted for longitudinally receiving said insert tongue therethrough, said plurality of supporting plates adapted as hinges rotatably guiding said first end of said insert tongue towards said first side of said frame.

11. The belt buckle according to claim 10 wherein said frame further comprises a brace plate recessed from said frame; said cylindrical cavity located at said brace plate for receiving said cylindrical pin of said male plate.

* * * * *